US009863172B2

(12) United States Patent
Burke et al.

(10) Patent No.: US 9,863,172 B2
(45) Date of Patent: Jan. 9, 2018

(54) RAILROAD CAR LUBRICANT FREE DOOR LOCK

(71) Applicant: Standard Car Truck Company, Park Ridge, IL (US)

(72) Inventors: Michael K. Burke, Wheaton, IL (US); Walter J. Peach, Montgomery, IL (US)

(73) Assignee: Standard Car Truck Company, Rosemont, IL (US)

( * ) Notice: Subject to any disclaimer, the term of this patent is extended or adjusted under 35 U.S.C. 154(b) by 336 days.

(21) Appl. No.: 14/567,518

(22) Filed: Dec. 11, 2014

(65) Prior Publication Data

US 2016/0168890 A1 Jun. 16, 2016

(51) Int. Cl.

| | |
|---|---|
| ***E05C 9/00*** | (2006.01) |
| ***E05C 1/00*** | (2006.01) |
| ***E05C 9/18*** | (2006.01) |
| ***B61D 19/00*** | (2006.01) |
| ***E05B 83/06*** | (2014.01) |
| ***E05B 17/00*** | (2006.01) |

(Continued)

(52) U.S. Cl.

CPC ..... *E05C 9/1833* (2013.01); *B61D 19/00* (2013.01); *E05B 17/007* (2013.01); *E05B 17/08* (2013.01); *E05B 83/06* (2013.01); *E05C 1/004* (2013.01); *E05B 53/003* (2013.01)

(58) Field of Classification Search

CPC ..... Y10T 292/0834; Y10T 292/0838; Y10T 292/0839; Y10T 292/0841; Y10T 292/0844; Y10T 292/0845; Y10T 292/096; Y10T 292/0969; Y10T 292/0972; Y10T 292/0974; Y10T 292/0975; Y10T 292/0992; Y10T 292/0994; Y10T 292/1015; Y10T 292/1017; Y10T 292/102; Y10T 16/53607; Y10T 16/5362; B61D 19/00; E05B 17/007; E05B 17/08; E05B 83/06; E05B 53/003; E05C 9/1833; E05C 1/004; Y10S 292/15; Y10S 292/18; Y10S 292/21; Y10S 292/32; Y10S 292/56; Y10S 292/57; Y10S 292/58; B60D 1/02

See application file for complete search history.

(56) References Cited

U.S. PATENT DOCUMENTS

| | | | |
|---|---|---|---|
| 1,910,102 | A | 5/1933 | Godfrey |
| 2,231,188 | A | 2/1941 | Iarrobino |

(Continued)

FOREIGN PATENT DOCUMENTS

WO WO 9925944 A1 * 5/1999 ..... E05B 53/003

*Primary Examiner* — Alyson M Merlino

(74) *Attorney, Agent, or Firm* — Neal, Gerber & Eisenberg LLP

(57) ABSTRACT

A railroad car door lock which eliminates the need for lubrication and which includes a bracket, a first base attached to the bracket, a second base attached to the bracket, aligned first and second apertures in the first and second bases for slidably receiving a locking pin, a replaceable first locking pin wear protector lockably insertable in and selectively removable from the first base to prevent contact between the locking pin and the inner edge of the first base which defines the first aperture, and a replaceable second locking pin wear protector lockably insertable in and selectively removable from the second base to prevent contact between the locking pin and the inner edge of the second base which defines the second aperture.

49 Claims, 16 Drawing Sheets

(51) Int. Cl.
*E05B 17/08* (2006.01)
*E05B 53/00* (2006.01)

(56) References Cited

U.S. PATENT DOCUMENTS 2,752,186 A * 6/1956 Morrison ..... E05C 1/065 292/139
3,193,335 A 7/1965 Wing
3,843,160 A * 10/1974 Frushour ..... B60D 1/02 280/416.1
3,874,752 A 4/1975 Imazaike
3,912,312 A 10/1975 Cerutti
3,995,563 A 12/1976 Blunden
4,461,160 A 7/1984 Gompel
4,778,205 A 10/1988 Sayre
4,909,638 A 3/1990 Muto
4,917,021 A 4/1990 Murphy
5,020,425 A 6/1991 Kelly
5,072,880 A 12/1991 McCloud
5,092,017 A 3/1992 Hatano et al.
5,145,265 A 9/1992 Flem
5,482,987 A 1/1996 Forschirm
5,520,466 A 5/1996 Everitt et al.
5,709,283 A * 1/1998 Nief ..... F16J 15/3268 180/428
5,797,685 A * 8/1998 Jurik ..... B60K 20/06 384/215
5,829,317 A 11/1998 Vreeken et al.
5,851,021 A 12/1998 Van Kley
6,086,327 A 7/2000 Mack et al.
6,485,180 B2 * 11/2002 Mena ..... B62D 3/12 384/215
6,527,311 B1 3/2003 Burke et al.
6,591,451 B2 * 7/2003 Gruber ..... E05D 5/121 16/254
6,708,625 B1 3/2004 Burke et al.
7,770,258 B2 * 8/2010 Rozkowski ..... B60R 22/26 16/2.1
9,409,267 B2 * 8/2016 Plantan ..... F16J 15/3268
9,423,012 B2 * 8/2016 Kuroiwa ..... F16J 15/3268

* cited by examiner

RAILROAD CAR LUBRICANT FREE DOOR LOCK

BACKGROUND

The railroad industry employs a variety of freight railroad cars for transporting products. Many of these freight railroad cars (such as boxcars and auto-rack railroad cars) are enclosed to protect the products or vehicles being transported. Enclosed railroad cars generally include one or more sliding doors to provide access to the interior of the railroad cars. The doors are generally mounted on upper and lower tracks which are attached to the frames of the railroad cars. The doors have conventional door locks to alternatively maintain the doors in an open position or a closed position.

Most conventional railroad car door locks must be lubricated with a standard lubricant such as grease. The lubricants such as grease attract particles and other materials, generally creating a dirty environment and sometimes causing contamination in the interior of the railroad cars.

This problem is especially undesirable in auto-rack railroad cars which transport newly manufactured vehicles, including automobiles, vans, and trucks, auto-rack railroad cars, known in the railroad industry as auto-rack cars, often travel thousands of miles through varying terrain. The typical auto-rack car is compartmented, having a frame, one, two or three decks or floors, two side walls, a roof, and a pair of doors at each end of the auto-rack car. The doors protect the auto-rack car from illegal or unauthorized entry and prevent theft or vandalism of the vehicles. The doors also prevent flying objects from entering the auto-rack car and damaging the vehicles. In transit, the doors on auto-rack cars are secured in the closed position. When the automobiles are being loaded or unloaded, the doors are secured in the open position. Examples of such doors for auto-rack cars are generally illustrated in U.S. Pat. Nos. 3,995,563 and 4,917,021.

Each door in an auto-rack car includes at least one door lock having a locking pin which engages a socket attached to the frame of the auto-rack car. The grease and dirt that builds up on these door locks often creates a dirty environment and can cause grease contamination inside the auto-rack cars. This is highly undesirable for the transport of newly manufactured vehicles because the grease and dirt can damage the finishes of the vehicles being transported. The grease also tends to drip or fall off the door locks onto the floors or door tracks of the auto-rack cars. Workers can step in this grease and then track the grease into the new vehicles being transported. Thus, the grease sometimes damages the interior carpeting in the new vehicles being transported.

The Association of American Railroads ("AAR") requires that the railroad car door locks and rollers be lubricated or greased every twelve months or sooner if necessary. The AAR also requires that the date on which the door locks and rollers are lubricated or greased be painted on the inside of the auto-rack cars for tracking purposes. This requires extensive tracking procedures for this regular maintenance which increases the cost of operating the auto-rack cars and decreases the efficiency of the use of the auto-rack cars.

Accordingly, there is a continuing need for door locks for railroad cars, and in particular for auto-rack cars, which do not need to be lubricated on a regular basis and which eliminate grease contamination.

SUMMARY

The present disclosure solves the above problems by providing a lubricant free door lock for railroad cars, and particularly for auto-rack railroad cars, which eliminates the need to use a lubricant such as grease to lubricate the door lock.

One embodiment of the railroad car lubricant free door lock of the present disclosure generally includes a steel C-shaped bracket having a side wall and spaced-apart upper and lower end walls attached to and extending transversely from the side wall. The upper and lower end walls include aligned apertures for slidably receiving a steel locking pin of the door lock. This embodiment of the lubricant free door lock of the present disclosure further includes: (a) a first or upper steel base which is attached (such as by welding) to the upper end wall and which defines an aperture for slidably receiving the locking pin; (b) a replaceable first locking pin wear protector securely insertable in and selectively removable from the upper base to: (i) prevent contact between the locking pin and the inner edge of the upper end wall which defines the aperture in the upper end wall; and (ii) prevent contact between the locking pin and the inner edge or shoulder of the upper base which defines the opening or aperture in the upper base; (c) a second or lower steel base which is attached (such as by welding) to the lower end wall and which defines an aperture for slidably receiving the locking pin; and (d) a replaceable second locking pin wear protector securely insertable in and selectively removable from the second base to: (i) prevent contact between the locking pin and the inner edge of the lower end wall which defines the aperture in the lower end wall; and (ii) prevent contact between the locking pin and the inner edge or shoulder of the lower base which defines the opening or aperture in lower base.

Another embodiment of the lubricant free door lock of the present disclosure generally includes a steel C-shaped bracket having a side wall and spaced-apart first and second end walls attached to and extending transversely from the side wall. This embodiment of the lubricant free door lock of the present disclosure further includes: (a) a first or upper steel base attached (such as by welding) to both of the first and second end walls; and (b) a second or lower steel base attached (such as by welding) to both of the first and second end walls. The upper and lower bases include aligned upper and lower openings or apertures for slidably receiving a steel locking pin of this door lock. This embodiment of the lubricant free door lock of the present disclosure further includes: (a) a replaceable first locking pin wear protector securely insertable in and selectively removable from the first base to prevent contact between the locking pin and the inner edge or shoulder of the upper base which defines the upper opening or aperture; and (b) a replaceable second locking pin wear protector securely insertable in and selectively removable from the second base to prevent contact between the locking pin and the inner edge of the lower base which defines the lower opening or aperture.

In various embodiments, the locking pin wear protectors are molded from a dry self-lubricating material having non-hygroscopic characteristics, a low coefficient of friction, a high compressive strength and a high resistance to wear. The locking pin wear protectors eliminate the need for a lubricant between the steel locking pin and the end walls of the bracket and/or the inner edges or walls of the bases.

The lubricant free door lock also includes a spring journaled about the locking pin, one or more washers journaled about the locking pin below the spring, and a stop extending transversely though the locking pin which co-act to provide the movement or action for the locking pin.

It is therefore an advantage of the present disclosure to provide a railroad car lubricant free door lock which eliminates the need to lubricate the door locks.

Other objects, features and advantages of the present invention will be apparent from the following detailed disclosure, taken in conjunction with the accompanying sheets of drawings, wherein like reference numerals refer to like parts.

DETAILED DESCRIPTION

Figure 1:
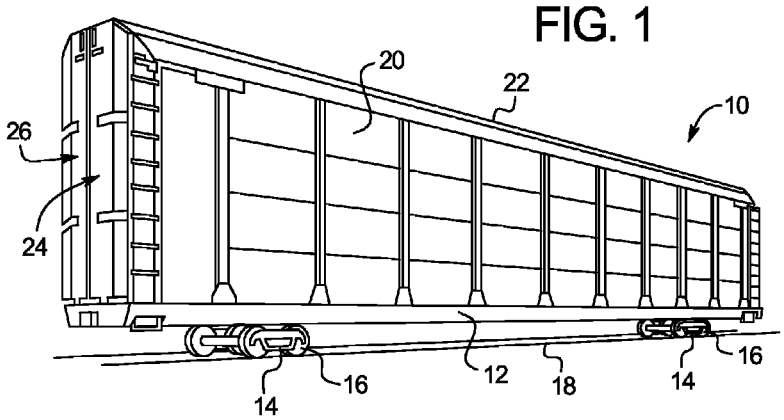
FIG. 1 is a perspective view of an auto-rack railroad car configured to transport a plurality of vehicles.

The lubricant free door lock of the present disclosure eliminates the need to lubricate door locks on doors in enclosed railroad cars. Various example embodiments of the railroad car lubricant free door lock of the present disclosure are described in detail below in relation to auto-rack cars, although the lubricant free door locks of the present disclosure are also suited for box cars and other freight railroad cars.

Referring now to the drawings, and particularly to FIGS. 1 to 9, a typical auto-rack railroad car 10 includes a frame 12 supported by trucks 14, each of which have several wheels 16 which are configured to roll along railroad tracks 18. The frame 12 supports two side walls 20 and a roof 22. The auto-rack car 10 includes a pair of co-acting clamshell doors 24 and 26 mounted on each end of the auto-rack car 10. The doors 24 and 26 are opened to facilitate the loading and unloading of vehicles into and out of the auto-rack car 10 and are typically closed during transport or storage of the vehicles. The right hand door 24 and the left hand door 26 (when viewed from the outside of the auto-rack car) are shown in closed position in FIGS. 1, 2, 4, and 5, and the left hand door 26 is shown in open position in FIG. 3 and in closed position in FIG. 6.

Figure 3:
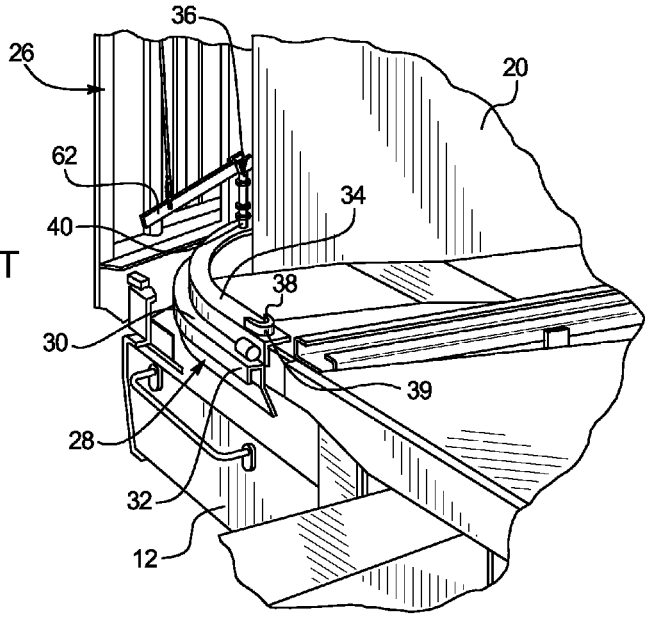
FIG. 3 PRIOR ART
FIG. 3 is a fragmentary perspective view of the end of an auto-rack car, the left hand door in open position and a conventional lower door lock for the left hand door.
Figure 4:
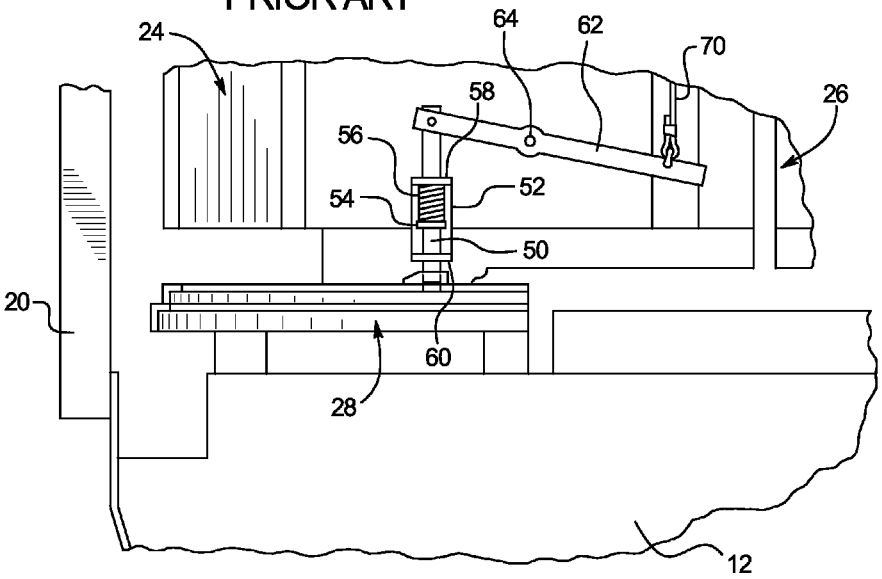
FIG. 4 PRIOR ART
FIG. 4 is an enlarged interior plan view of a conventional lower door lock for a right hand door in an auto-rack railroad car.

As best illustrated in FIG. 3, the doors 24 and 26 are supported and guided at their bottom ends by lower door tracks 28 mounted on the frame 12 and are guided at their upper ends by upper door tracks (not shown). The steel door track 28 includes a first substantially horizontally disposed door wheel bearing member 30 and a substantially vertically disposed door guide member 32 integrally formed with the outer edge of the bearing member 30. The door track 28 further includes a somewhat offset and higher second horizontally disposed member or ledge 34. The member or ledge 34 includes two spaced apart sockets 38 and 40 for co-acting with a door lock 36 on door 26. Socket 38 co-acts with a door lock 36 when door 26 is in closed position, and socket 40 co-acts with a door lock 36 when door 26 is in the open position. The member or ledge 34 also includes a stop 39 associated with each socket 38 and 40 which limits the movement of the door. Stop 39 is illustrated in FIG. 3.

Various conventional door locks found in the prior art which are currently being used on railroad cars are illustrated in FIGS. 3 through 9. As specifically illustrated in FIG. 6, each door has a locking assembly 42 which includes a lower door lock 36 and an upper door lock **36*a* interconnected by a cable 70 which causes the door locks 36 and 36*a* to operate in unison to lock and unlock the doors. As illustrated in FIGS. 3, 4, 6, and 7, the lower door lock 36 includes a vertically disposed locking pin 50 mounted in a substantially C-shaped bracket 52 which is mounted on the door. The locking pin 50 is aligned with and received in socket 38 if the door is in the closed position and aligned with and received in socket 40 if the door is in the open position. The door locks 36 include grease caps or grease fittings 63 and 64 on the upper and lower end walls 58 and 60 of the bracket 52 as illustrated in more detail in FIGS. 7 and 8**.

Conventional door lock 36 also includes a spring 56 mounted on the locking pin 50 and disposed between the upper and lower end walls 58 and 60 of the bracket 52. The spring 56 is bottomed at one end against the grease cap or fitting 63 on the upper wall 58 and at the other end against a washer 54 which is mounted on the locking pin 50. The spring 56 normally urges the locking pin 50 downwardly.

Figure 2:
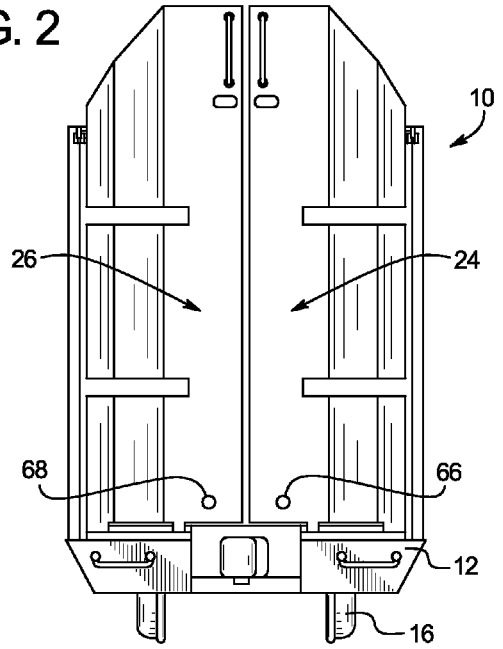
FIG. 2 is an end view of an auto-rack railroad car illustrating the doors at one end of the railroad car.

An actuating lever 62 is pivotally mounted on the door and pivotally attached to the top end of the locking pin 50. The actuating lever 62 is rotated or actuated using a key (not shown) which is inserted through keyholes 66 and 68 in the doors 24 and 26 as illustrated in FIG. 2. The rotation of the actuating lever 62 causes an upward force on the locking pin 50 and a downward force on the outer free end of the actuating lever 62 which is connected to the cable 70. When the actuating lever 62 is rotated, the cable 70 connected to the actuating lever 62*a* on the upper door lock 36*a* is likewise actuated to cause the locking pin 50*a* to disengage socket 38*a* on the upper deck or floor of the car to unlock the door and allow it to be moved either from closed position to open position or from open position to closed position as illustrated in FIG. 5.

Figure 5:
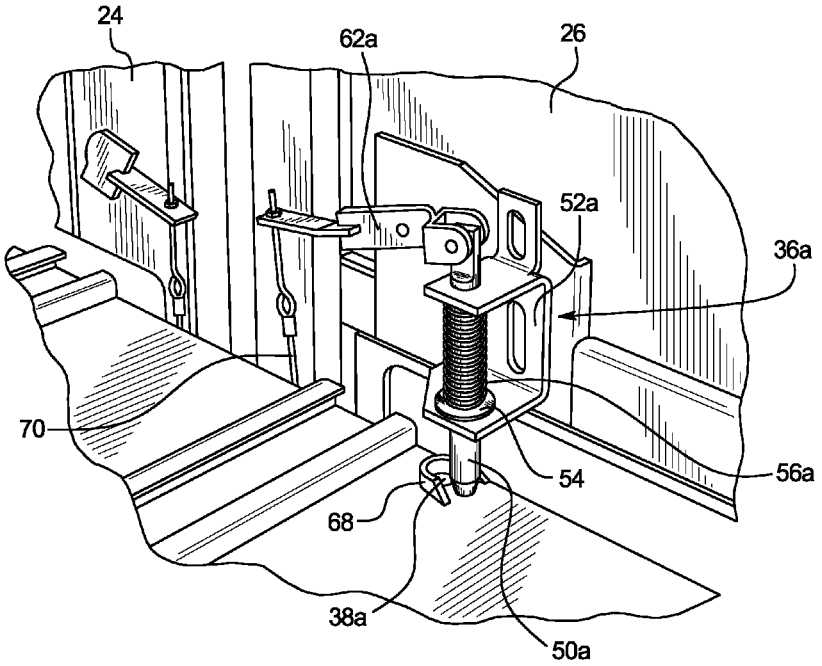
FIG. 5 PRIOR ART
FIG. 5 is a fragmentary perspective view of a conventional upper door lock for a left hand door.
Figure 6:
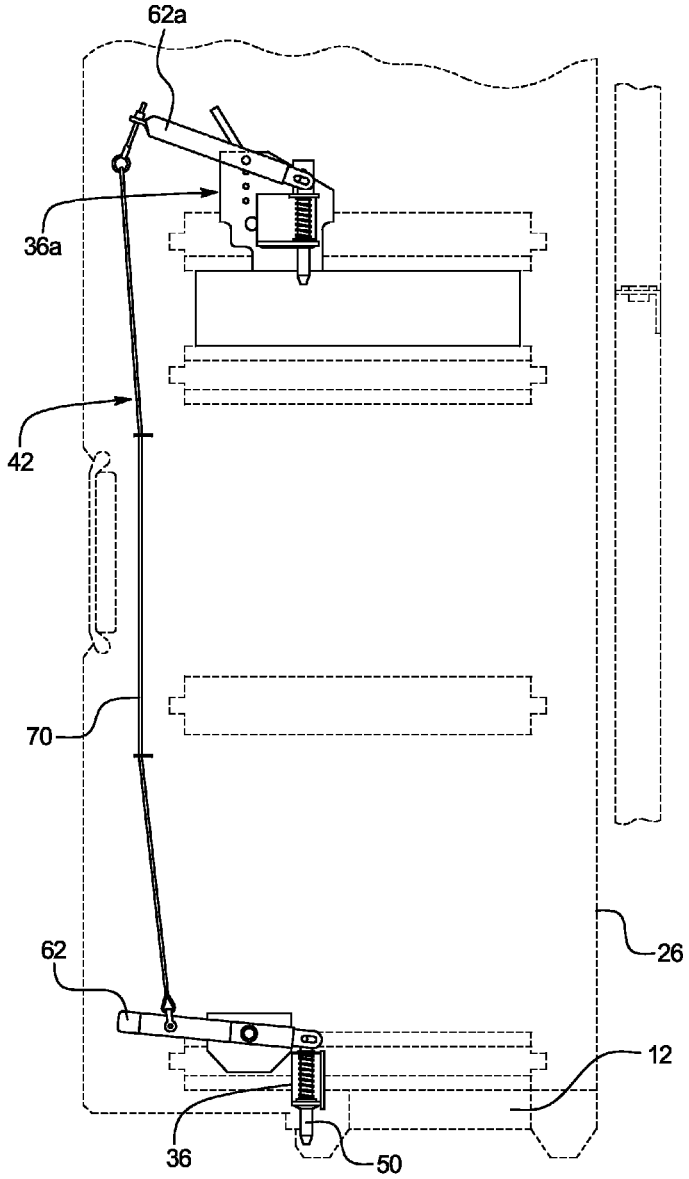
FIG. 6 PRIOR ART
FIG. 6 is an interior plan view of a conventional locking assembly for a left hand door including interconnected upper and lower door locks.
Figure 7:
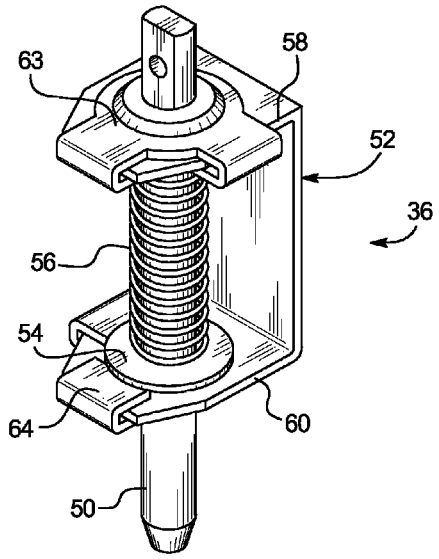
FIG. 7 PRIOR ART
FIG. 7 is an enlarged perspective view of a conventional lower door lock.
Figure 8:
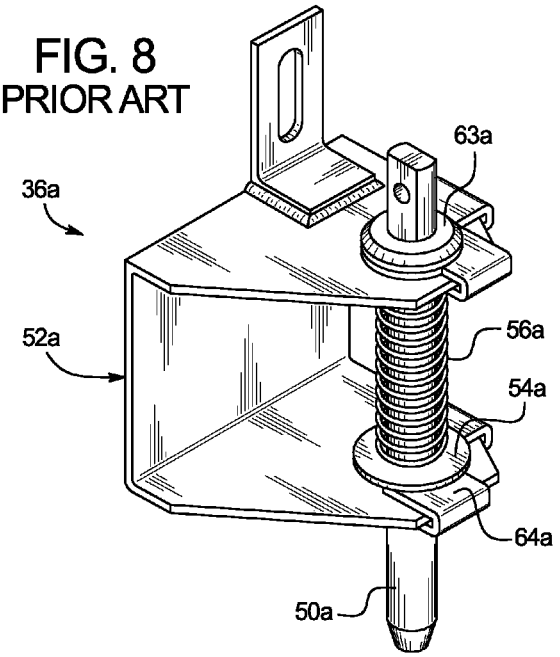
FIG. 8 PRIOR ART
FIG. 8 is an enlarged perspective view of a conventional upper door lock.

The upper door lock 36*a*, as illustrated in FIGS. 5 and 8, has an alternatively shaped bracket, but generally has identical working parts including a locking pin 50*a*, a spring 56*a*, a washer 54*a*, and grease caps or fittings 63*a* and 64*a*. A stop 68 is associated with socket 38*a* to assist in stopping the door 26 when it reaches the closed position. The lower end of the locking pin 50*a* is beveled to facilitate entry of the locking pin 50*a* into the socket 38*a*. Release of a force on the actuating lever 62*a* will enable the spring 56*a* to force the locking pin 50*a* downwardly so that it will sit in a socket 38*a* when the locking pin 50*a* is aligned with the socket 38*a* and thereby maintain the door in the open or closed position.

Figure 9:
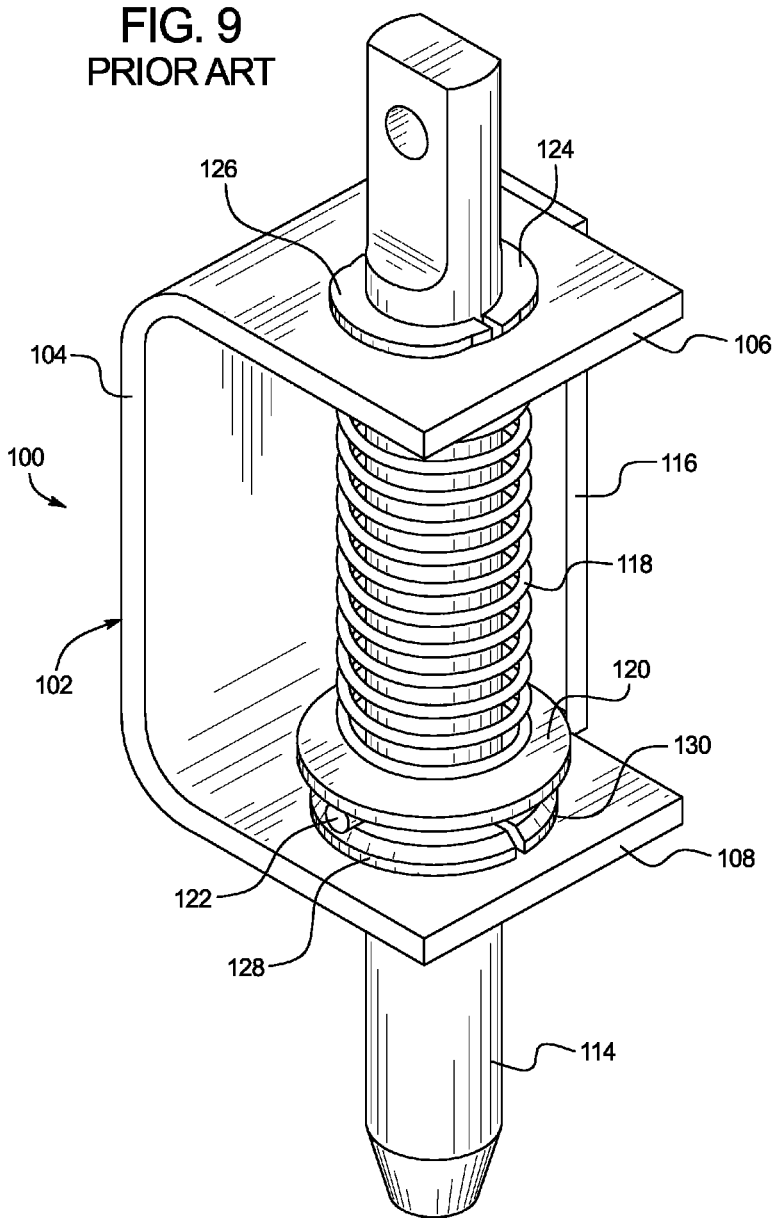
FIG. 9 PRIOR ART
FIG. 9 is an enlarged perspective view of a known greaseless door lock.
Figure 10:
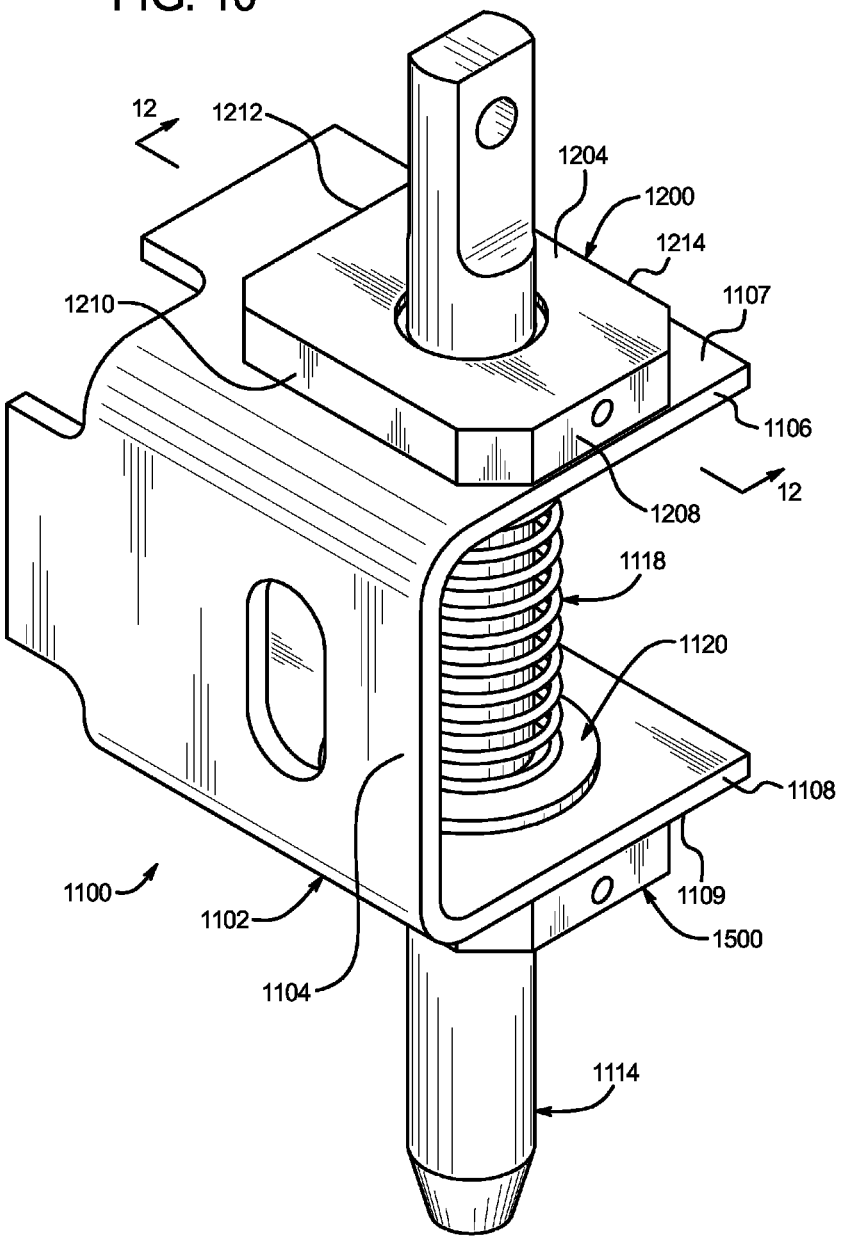
FIG. 10 is an enlarged perspective view of one embodiment of the lubricant free door lock of the present disclosure.

Referring now to FIG. 9, one known greaseless door lock 100 includes a substantially C-shape bracket 102 having a side wall 104 and spaced-apart upper and lower end walls 106 and 108 integrally connected to and extending transversely from the side wall 104. The end walls 106 and 108 include suitably sized aligned cylindrical upper and lower apertures (not shown), defined by inner edges (not shown) of end walls 106 and 108, respectively, for receiving a cylindrical locking pin 114. A mounting plate 116 is attached to the bracket 102 and specifically welded to the side wall 104 and end walls 106 and 108 of the bracket 102. The locking pin 114 extends through the upper and lower apertures (not shown) in the upper end wall 106 and lower end wall 108 and is secured in the bracket 102 by a spring 118 journaled about the locking pin 114, a disc-shaped washer 120 journaled about the locking pin 114 below the spring 118 and a stop 122 extending transversely through a transverse hole in the locking pin 114. The stop 122 maintains or supports the washer 120, and the spring 118 is buttoned or bottomed against the washer 120 to create the downward force on the locking pin 114. Upper collars 124 and 126 are positioned in the upper aperture between the outer circumference of locking pin 114 and the inner edge of the upper end wall 106 which defines the upper aperture. Lower collars 128 and 130 are positioned in the lower aperture between the outer circumference of locking pin 114 and the inner edge of the lower end wall 108 which defines the lower aperture. The locking pin 114 is suitably sized to maintain the semi-cylindrical collars 124, 126, 128, and 130 in place and prevent the displacement of the collars.

Referring now to FIGS. 10, 11, 12, 13, 14, and 15, one embodiment of the lubricant free railroad car door lock of the present disclosure is generally illustrated and indicated by numeral 1100. This illustrated example lubricant free railroad car door lock 1100 includes a substantially C-shape bracket 1102 having a side wall 1104, a first or upper end wall 1106 integrally connected to and extending transversely from the side wall 1104, and a second or lower end wall 1108 integrally connected to and extending transversely from the side wall 1104. The upper and lower end walls 1106 and 1108 are suitably spaced apart from each other. The end walls 1106 and 1108 respectively define suitably sized aligned cylindrical first and second openings or apertures 1110 and 1112. More specifically, end walls 1106 and 1108 respectively include cylindrical inner edges 1111 and 1113 that define the aligned first and second cylindrical apertures 1110 and 1112. In the assembled position, the locking pin 1114 extends through apertures 1110 and 1112 in the upper end wall 1106 and lower end wall 1108. The door lock 1100 further includes a spring 1118 journaled about the locking pin 1114, a first disc-shaped washer 1120 journaled about the locking pin 1114 below the spring 1118, and a stop 1124 extending transversely through (and out of both sides of) a transverse hole 1123 in the locking pin 1114. The stop 1124 maintains or supports the washer 1120, and the spring 1118 is buttoned or bottomed against the washer 1120 to create the downward force on the locking pin 1114.

Although not shown, this embodiment of the lubricant free railroad car door lock may also include one or more mounting plates for suitable attachment to one of the doors of the railroad car. In certain such embodiments, each mounting plate is attached to the bracket and specifically welded to the side wall and/or one or more end walls of the bracket.

As shown in FIGS. 10, 11, 12, 13, 14, and 15, this example embodiment of the lubricant free door lock 1100 of the present disclosure further includes: (a) a first or upper steel base 1200 attached (such as by welding) to the top of the upper end wall 1106; and (b) a generally cylindrical replaceable first locking pin wear protector 1300 securely insertable in and selectively removable from the first base 1200 to: (i) prevent steel-on-steel contact between the locking pin 1114 and the inner edge 1111 of the upper end wall 1106; and (ii) prevent steel-on-steel contact between the locking pin 1114 and the inner edge or shoulder 1250 of the upper base 1200.

This example embodiment of the lubricant free door lock 1100 of the present disclosure further includes: (a) a second or lower base 1500 attached (such as by welding) to the bottom of the lower end wall 1108; and (b) a generally cylindrical replaceable second locking pin wear protector 1600 securely insertable in and selectively removable from the second base 1500 to: (i) prevent the steel-on-steel contact between the locking pin 1114 and the inner edge 1113 of the lower end wall 1108; and (ii) prevent steel-on-steel contact between the locking pin 1114 and the inner edge or shoulder of the lower base 1500.

In various embodiments, each locking pin wear protector is formed from a suitable a dry self-lubricating material having non-hygroscopic characteristics, a low coefficient of friction, a high compressive strength, and a high resistance to wear. For example, in certain embodiments, each locking pin wear protector is molded from a urethane. It should be appreciated that one or more of the locking pin wear protectors can be made from other suitable materials such as UHMW polyethylene, a polyoxymethylene (such as a polyoxymethylene sold under the name DELRIN), or another polymer such as a moly disulfide filled nylon. As further discussed below, the locking pin wear protectors eliminate the need for a lubricant between the steel locking pin and the end walls of the bracket and the inner edges or shoulders of the bases.

In this illustrated example embodiment, the first or upper base 1200 is identical to the second or lower base 1500, and the locking pin wear protector 1300 is identical to the locking pin wear protector 1600. However, it should be appreciated that these components do not need to be identical in accordance with the present disclosure. It should also be appreciated that the bases 1200 and 1500 are secured or attached to the bracket 1102 in this illustrated embodiment such that they face each other as further described below, and that in alternative embodiments, the bases can be secured in other suitable manners such as facing away from each other, or both facing in one direction (such as an upward direction or a downward direction).

Since, in this illustrated example embodiment, the first or upper base 1200 is identical to the second or lower base 1500, and the locking pin wear protector 1300 is identical to the locking pin wear protector 1600, these components are discussed in more detail with reference to the first or upper base 1200 and the first locking pin wear protector 1300.

The first or upper base 1200 includes a body 1202 having a first face or surface 1204, a second face or surface 1206, a first side surface or end 1208, a second side surface or end 1210, a third side surface or end 1212, and a fourth side surface or end 1214. The body 1202 includes a cylindrical locking pin wear protector engagement shelf 1220 and a cylindrical inner edge or locking pin wear protector engagement shoulder 1230 which define a cylindrical locking pin wear protector receipt opening or aperture 1240. The body 1202 further includes a second inner edge or shoulder 1250 which defines a locking pin receipt opening or aperture 1260 through which the locking pin 1114 extends. The body 1202 further defines a cylindrical first engagement pin receipt channel 1270 extending transversely in the body 1202 and a cylindrical second engagement pin receipt channel 1280 extending transversely in the body 1202.

In this embodiment, the first or upper base 1200 is made from a suitable steel, although it could be made from other suitable materials. In this embodiment, the first or upper base 1200 is welded to the top surface 1107 of the end wall 1106, and specifically with surface 1204 of the first or upper base 1200 facing and contacting the top surface 1107 of the end wall 1106. It should be appreciated that the openings, apertures, and channels defined by the body 1200 can be machined or otherwise suitably formed in the body 1500. It should also be appreciate that the base can be made in other suitable configurations, and that the cylindrical portions can be alternatively shaped.

Figure 14:
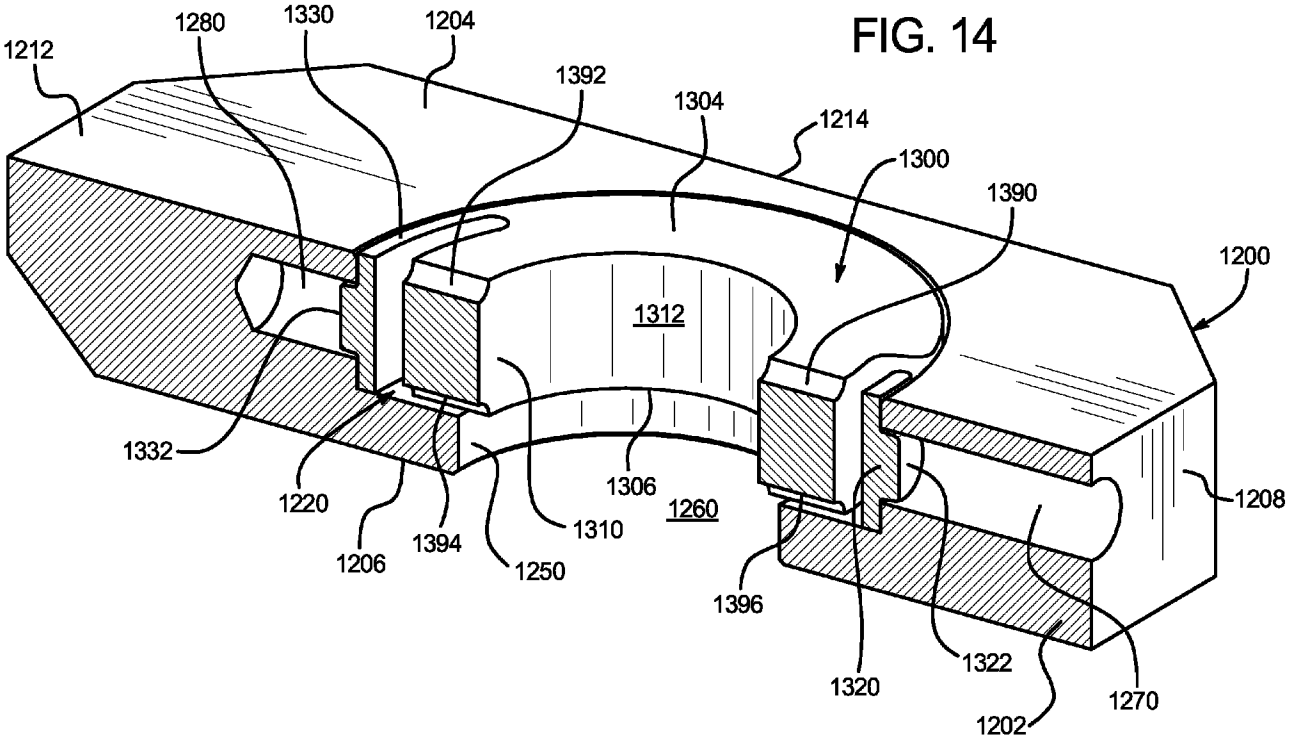
FIG. 14 is an enlarged cross-sectional perspective view of the base and locking pin wear protector of the lubricant free door lock of FIG. 10, taken substantially through line 14-14 of FIG. 13.

The first locking pin wear protector 1300 includes a cylindrical body 1302 having a first surface 1304, a second surface 1306, a cylindrical outer side surface 1308, and a cylindrical locking pin engagement inner edge or shoulder 1310 which defines a locking pin receipt opening or aperture 1312. The inner edge or shoulder 1310 is configured to engage the locking pin 1114, as further discussed below. The body 1302 defines or includes a first locking arm 1320 having a first outwardly or transversely extending base engagement pin 1322, and a second locking arm 1330 having a second outwardly or transversely extending base engagement pin 1332. As best illustrated in FIG. 14, the first locking pin wear protector 1300 is configured to be positioned in the first or upper base 1200, and specifically in the cylindrical locking pin wear protector receipt opening or aperture 1240 such that: (1) the second surface 1306 engages or can engage the cylindrical locking pin wear protector engagement shelf 1220; (2) the first base engagement pin 1322 extends into the first engagement pin receipt channel 1270; and (3) the second base engagement pin 1332 extends into the second engagement pin receipt channel 1280. This configuration securely (but removably) holds the first pin wear protector 1300 in or attached to the first or upper base 1200. It should be appreciated that an object such as a screwdriver can be inserted through channel 1270 in the first or upper base 1200 to dis-engage the first base engagement pin 1322 from the first engagement pin receipt channel 1270, and thus enable the first locking pin wear protector 1300 to be removed from the first or upper base 1200.

It should be appreciated that the body 1302, the second surface 1306, the outer side surface 1308, the first locking arm 1320, the first base engagement pin 1322, the second locking arm 1330, and the second base engagement pin 1332 are configured such that when the first locking pin wear protector 1300 is placed in the locking pin wear protector receipt opening 1240 in the first or upper base 1200, the second surface 1306 engages or can engage the locking pin wear protector support shelf 1220, the outer side surface 1308 engages or can engage the locking pin wear protector engagement inner edge or shoulder 1230, the first base engagement pin 1322 extends into the channel 1270, and the second pin 1332 extends into the second channel 1280. This removably secures the first locking pin wear protector 1300 in the first base 1200.

Figure 13:
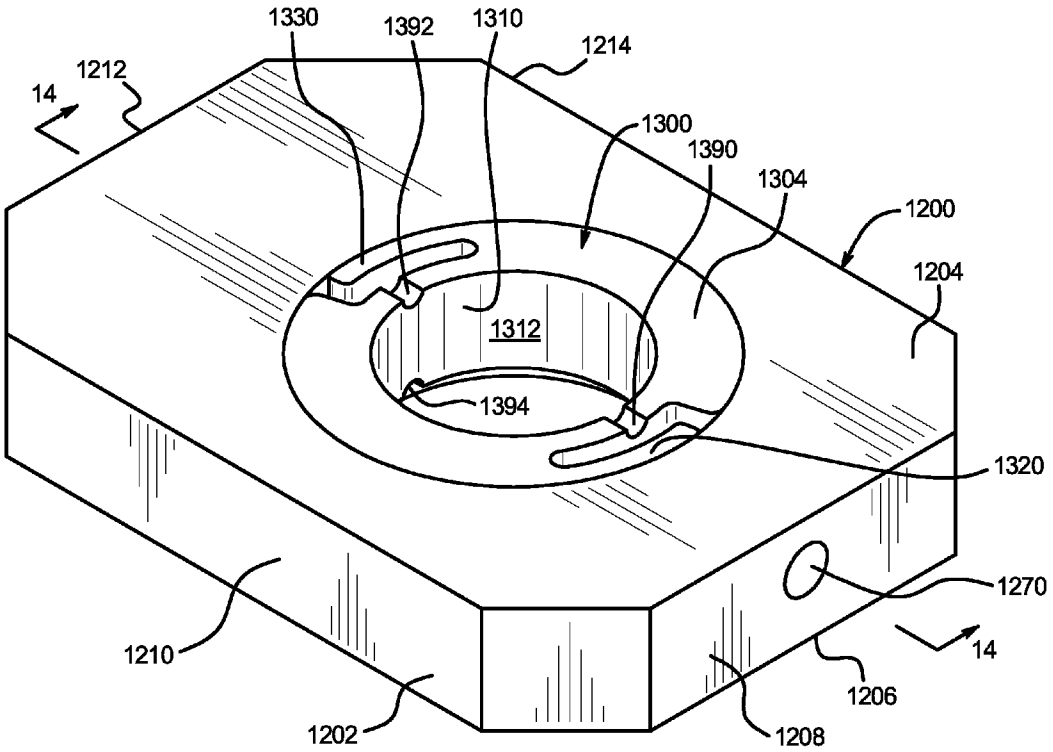
FIG. 13 is an enlarged perspective view of the base and locking pin wear protector of the lubricant free door lock of FIG. 10, shown prior to attachment to the C-shaped bracket.
Figure 15:
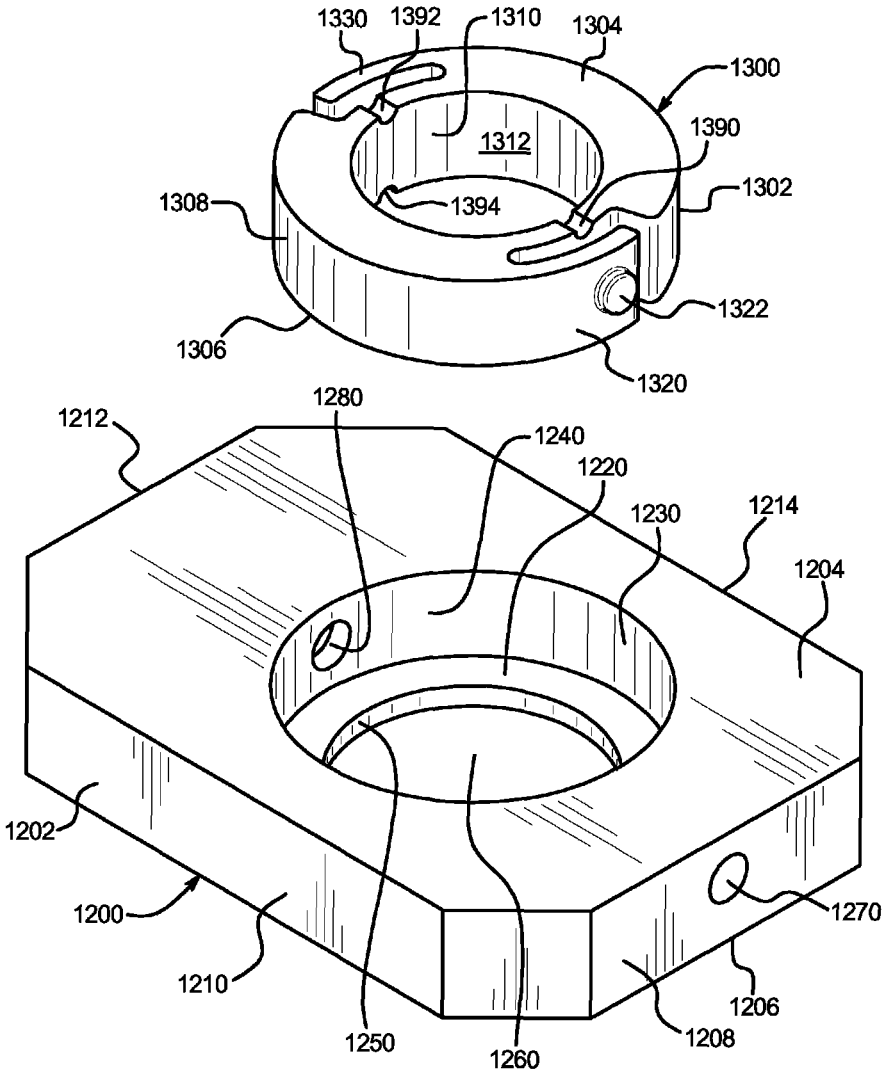
FIG. 15 is an enlarged exploded perspective view of the base and locking pin wear protector of the lubricant free door lock of FIG. 10.

More specifically, in this illustrated embodiment, the first and second locking arms 1320 and 1330 have free ends and have normal or resting positions as shown in FIGS. 13, 14, and 15. These locking arms are configured such that when the first locking pin wear protector 1300 is placed into the first base 1200, one or both of the first locking arm 1320 (including the first base engagement pin 1322) and the second locking arm 1330 (including the second base engagement pin) 1332 flex, bend, or move inwardly (against their respective normal positions or bias) as the locking pin wear protector 1300 is moved into the first pin wear protector receipt opening 1240. When the first locking pin wear protector 1300 is in the correct position in the locking pin wear protector opening 1240, the first base engagement pin 1320 extends into the first channel 1270 and the second base engagement pin 1322 extends into the second channel 1280, allowing the first locking arm 1320 and the second locking arm 1330 to return to their normal positions. This securely holds the locking pin wear protector 1300 in the base 1200. It should be appreciated that in other embodiments, one or more of the locking arms may be further outwardly biased (or have a normal position extending outwardly). It should also be appreciated that the locking pin wear protector can be made in other suitable configurations and that the cylindrical portions can be alternatively shaped.

This illustrated embodiment of the locking pin wear protector 1300 of the present disclosure further includes or defines aligned guides (such as grooves 1390, 1392, 1394, and 1396) which indicate to the installer the proper alignment of the base engagement pins 1322 and 1332 and thus the proper alignment of the locking pin wear protector 1300 in the base 1200. These grooves also function as water drains.

As mentioned above, to remove the first locking pin wear protector 1300 from the base 1200, an object such as a screwdriver (not shown) is inserted into and through the first channel 1270 and into engagement with the first base engagement pin 1322. The object causes the first locking arm 1320 including the first base engagement pin 1322 to flex, bend, or move inwardly (against its bias) and to disengage from the first channel 1270, thereby enabling removal of the first locking pin wear protector 1300 from the base 1200.

It should be appreciated that in this illustrated embodiment, the locking pin receipt opening 1312 (of the first locking pin wear protector 1300) has a smaller diameter than the locking pin receipt opening 1260 (of the base 1200), and that the locking pin receipt opening 1260 (of the base 1200) has a smaller diameter than the aperture 1110 in the upper end wall 1106. This configuration causes the locking pin 1114 to engage the inner edge 1310 of the first locking pin wear protector 1300 instead of engaging the base 1300 or the end wall 1106.

It should further be appreciated that the first locking pin wear protector 1300 has a smaller outer diameter the than aperture 1110 in the upper end wall 1106. This configuration enables the first locking pin wear protector 1300 to be inserted upwardly through the aperture 1110 in the end wall 1106 and into the upper base 1200 during assembly of door lock 1100 after the upper base 1200 is welded to the top of the end wall 1106. If the first locking pin wear protector 1300 breaks, wears out, or otherwise needs to be replaced, the first locking pin wear protector 1300 can be unlocked or detached from the upper base 1200 and removed (by moving downwardly through the aperture 1110 in the end wall 1106) and replaced with another first locking pin wear protector (which is moved upwardly through the aperture 1110 in the end wall 1106 and locked into the upper base 1200). This configuration provides for relatively easy replacement of the first locking pin wear protector 1300. It should be appreciated that to replace the locking pin wear protector 1300, the locking pin 1114 is first removed from its position extending through the bracket 1102, the locking pin wear protector 1300 and the base 1200.

Figure 11:
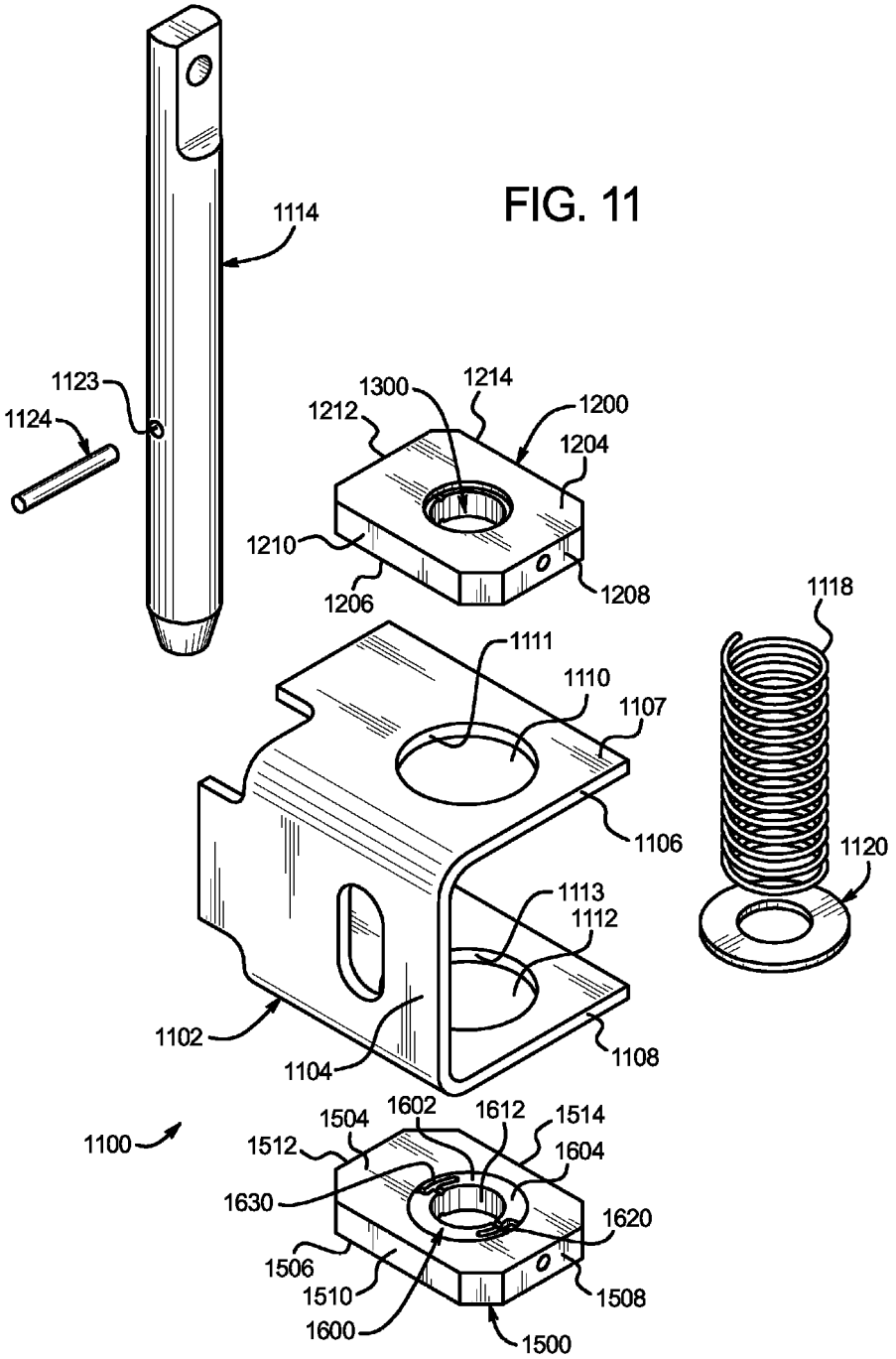
FIG. 11 is an enlarged exploded perspective view of the lubricant free door lock of FIG. 10.
Figure 12:
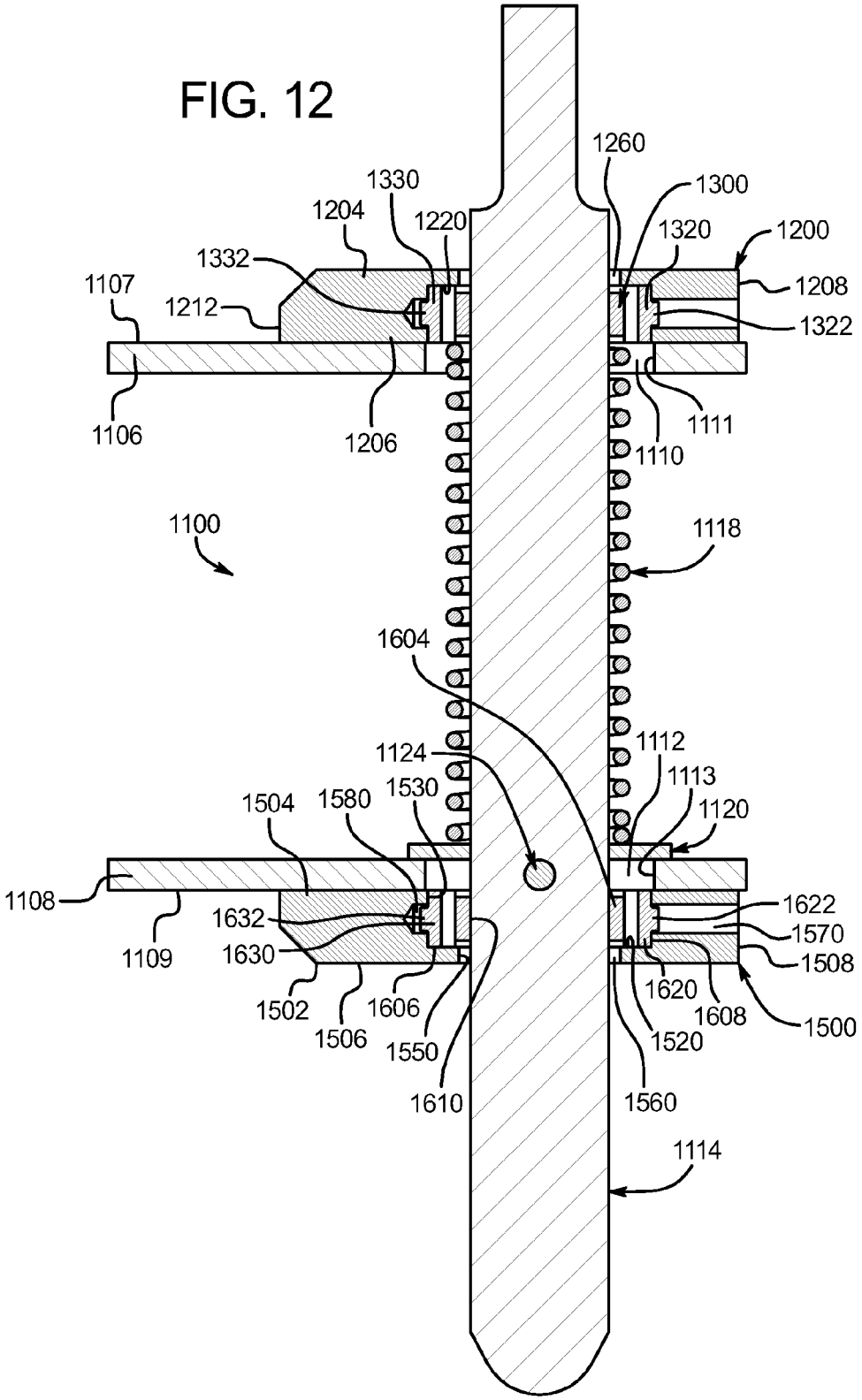
FIG. 12 is cross-sectional view of the lubricant free door lock of FIG. 10, taken substantially through line 12-12 of FIG. 10.

Like the first or upper base 1200, as best seen in FIGS. 11 and 12, the second or lower base 1500 includes a body 1502 having a first face or surface 1504, a second face or surface 1506, a first side surface or end 1508, a second side surface or end 1510, a third side surface or end 1512, and a fourth side surface or end 1514. The body 1502 includes a cylindrical locking pin wear protector engagement shelf 1520 and a cylindrical locking pin wear protector engagement inner edge or shoulder 1530 which define a locking pin wear protector receipt opening (not shown). The body 1502 further includes a second inner edge or shoulder 1550 which defines a locking pin receipt opening 1560 through which the locking pin 1114 extends. The body 1502 further defines a first engagement pin receipt channel 1570 extending transversely in the body 1502 and a second engagement pin receipt channel 1580 extending transversely in the body 1502. In this embodiment, the second or lower base 1500 is made from a suitable steel, although it could be made from other suitable materials and in other suitable configurations. In this embodiment, the second or lower base 1500 is welded to the bottom surface 1109 of the end wall 1108, and specifically with surface 1504 of the second or lower base 1500 facing and contacting the bottom surface 1109 of the end wall 1108. It should be appreciated that the openings, apertures, and channels defined by the body 1500 can be machined or otherwise suitably formed in the body 1500.

Like the first locking pin wear protector 1300, the second locking pin wear protector 1600 includes a cylindrical body 1602 having a first surface 1604, a second surface 1606, a cylindrical outer side surface 1608, and a cylindrical or locking pin engagement inner edge or shoulder 1610 which defines a locking pin receipt opening 1612. The inner edge or shoulder 1610 is configured to engage the locking pin 1114. The body 1602 defines or includes a first locking arm 1620 having a first outwardly or transversely extending base engagement pin 1622, and a second locking arm 1630 having a second outwardly or transversely extending base engagement pin 1632. As best illustrated in FIG. 12, the second locking pin wear protector 1600 is configured to be positioned in and attached to the second or lower base 1500, and specifically in the cylindrical locking pin wear protector receipt opening (not shown) of the second base 1500 such that: (1) the second surface 1506 engages or can engage the cylindrical locking pin wear protector engagement shelf of the second base 1500; (2) the first base engagement pin 1622 extends into the first engagement pin receipt channel 1570; and (3) the second base engagement pin 1632 extends into the second engagement pin receipt channel 1580. This configuration securely (but removably) holds the second locking pin wear protector 1600 in the second or lower base 1500. As mentioned above, an object such as a screwdriver can be inserted through channel 1570 in the lower base 1500 to dis-engage the base engagement pin 1522 from the first engagement pin receipt channel 1570, and thus enable the second locking pin wear protector 1600 to be removed from the base 1500.

It should also be appreciated that the body 1602, the second surface 1606, the outer side surface 1608, the first locking arm 1620, the first pin 1622, the second locking arm 1630, and the second pin 1632 are configured such that when the first locking pin wear protector 1600 is placed in the locking pin wear protector receipt opening in the second base 1500, the second surface 1606 engages or can engage the pin wear protector support shelf 1520, the outer side surface 1608 engages or can engage the inner pin wear protector engagement shoulder 1530, the first base engagement pin 1622 extends into the channel 1570, and the second base engagement pin 1632 extends into the channel 1580. This removably secures the second locking pin wear protector 1600 in the second base 1500.

Like the first locking pin wear protector 1300 as described above, to place the second locking pin wear protector 1600 into the second base 1500, one or both of the first locking arm 1620 (including the first base engagement pin 1622) and the second locking arm 1630 (including the second base engagement pin 1632) are moved inwardly as the locking pin wear protector 1600 is moved into the first locking pin wear protector receipt opening. Like the first locking pin wear protector 1300 as described above, to remove the second locking pin wear protector 1600 from the second base 1500, an object (not shown) is inserted into and through the channel 1570 and into engagement with the first base engagement pin 1622. The object causes the locking arm 1620 (including the first base engagement pin 1622) to move inwardly and to disengage from the channel 1570, thereby enabling removal of the second locking pin wear protector 1400 from the second base 1500.

It should be appreciated that in this illustrated embodiment, the locking pin receipt opening 1612 (of the second locking pin wear protector 1600) has a smaller diameter than the locking pin receipt opening 1560 (of the base 1500), and that the locking pin receipt opening 1560 (of the base 1500) has a smaller diameter than the aperture 1112 in the lower end wall 1108. This configuration causes the locking pin 1114 to engage the inner surface 1612 of the second locking pin wear protector 1600 instead of engaging the base 1500 or the end wall 1108.

It should further be appreciated that the second locking pin wear protector 1600 has a smaller outer diameter than aperture 1112 in the lower end wall 1108. This configuration enables the second locking pin wear protector 1600 to be inserted downwardly through the aperture 1112 in the end wall 1108 and into the lower base 1500 during assembly of door lock 1100 after the lower base 1500 is welded to the bottom of the end wall 1108. If the second locking pin wear protector 1600 breaks, wears out, or otherwise needs to be replaced, the second locking pin wear protector 1600 can be unlocked or detached from the lower base 1500 and removed (by moving upwardly through the aperture 1112 in the end wall 1108) and replaced with another first locking pin wear protector (which is moved downwardly through the aperture 1112 in the end wall 1108 and locked into the lower base 1500). This configuration provides for relatively easy replacement of the second locking pin wear protector 1600. It should, of course, be appreciated that the locking pin 1114 would need to be removed from the door lock 1100 before the locking pin wear protector 1600 is removed and replaced. This illustrated embodiment of the locking pin wear protector 1600 of the present disclosure further includes or defines aligned guides (such as grooves or water drains)) which indicate to the installer the proper alignment of the engagement pins 1622 and 1632 and thus the proper alignment of the locking pin wear protector 1600 in the base 1500.

Figure 16:
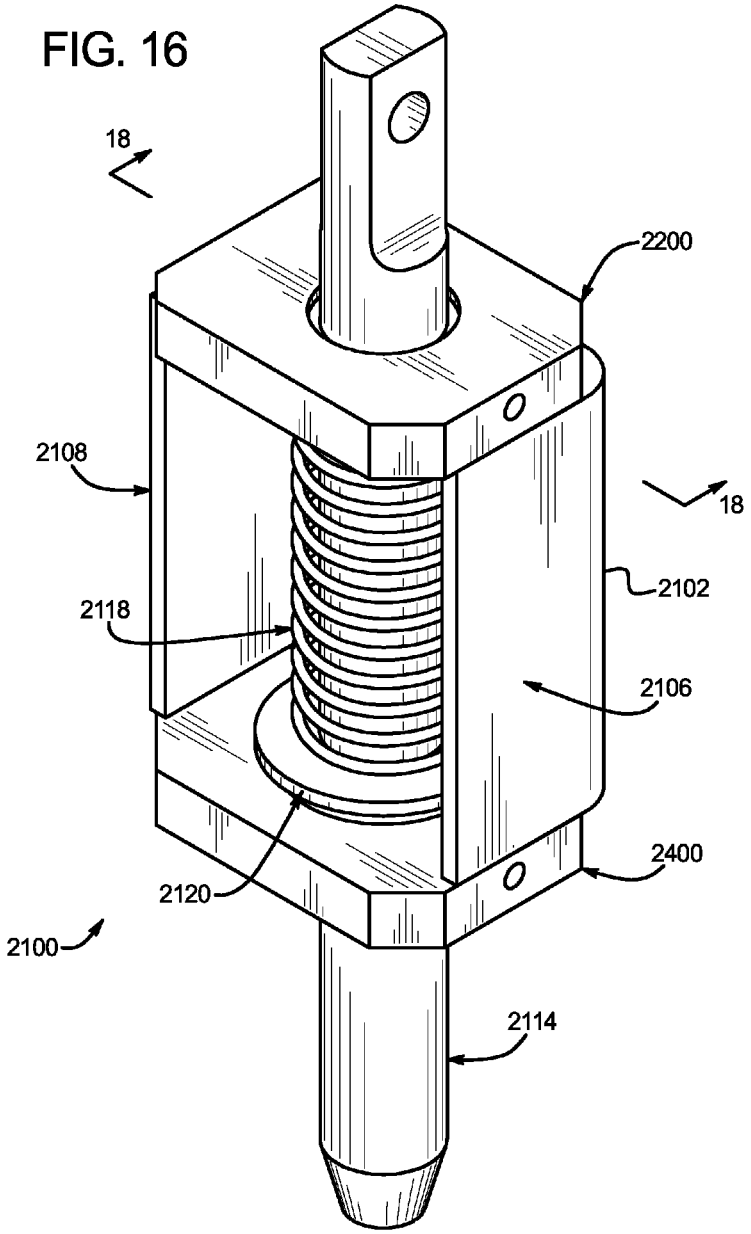
FIG. 16 is an enlarged perspective view of another embodiment of the lubricant free door lock of the present disclosure.
Figure 17:
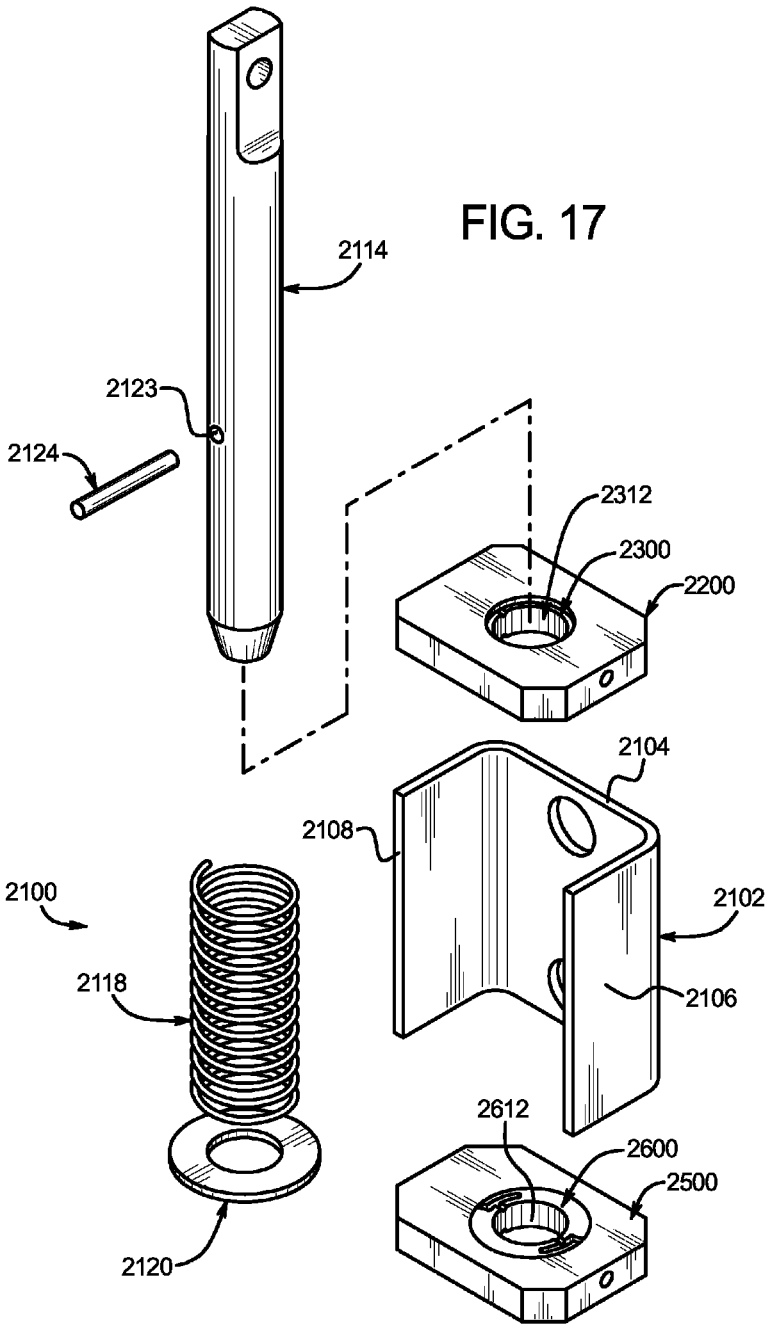
FIG. 17 is an enlarged exploded perspective view of the lubricant free door lock of FIG. 16.
Figure 18:
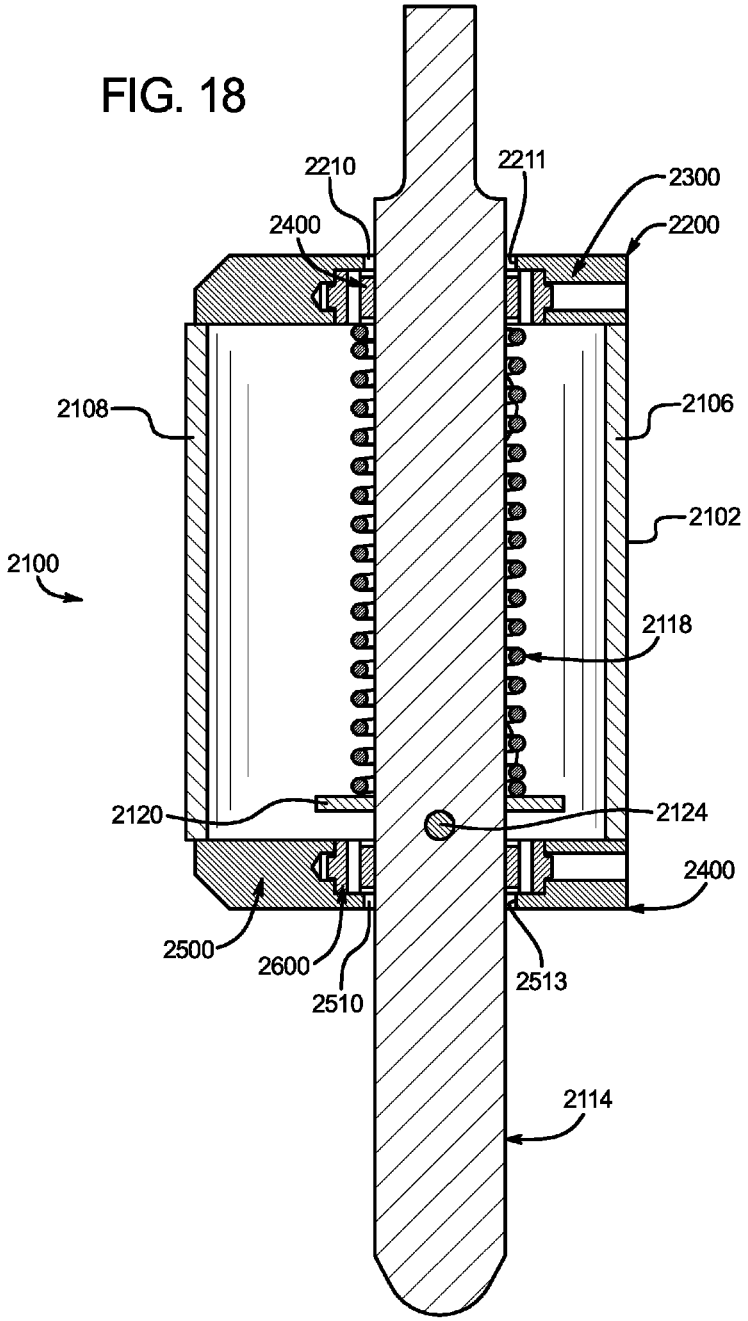
FIG. 18 is cross-sectional view of the lubricant free door lock of FIG. 16, taken substantially through line 18-18 of FIG. 16.

Referring now to FIGS. 16, 17, and 18, another embodiment of the lubricant free door lock of the present disclosure is generally illustrated and indicated by numeral 2100. This example embodiment is different than the above example embodiment in the configuration of the bracket and in the attachment of the bases to the bracket. More specifically, this example lubricant free door lock 2100 includes a substantially C-shape bracket 2102 having a side wall 2104 and spaced-apart first and second end walls 2106 and 2108 integrally connected to and extending transversely from the side wall 2104. The first and second end walls 2106 and 2108 are suitably spaced apart from each other.

Although not shown, this embodiment of the lubricant free door lock may also include one or more mounting plates for suitable attachment to a door of the railroad car. In certain such embodiments, each mounting plate is attached to the bracket and specifically welded to the side wall and/or one or more end walls and of the bracket.

This embodiment of the lubricant free door lock 2100 of the present disclosure further includes: (a) a first or upper steel base 2200 attached (such as by welding) to the respective top portions of the end walls 2106 and 2108; and (b) a second or lower steel base 2500 attached (such as by welding) to the respective bottom portions of the end walls 2106 and 2108. The bases 2200 and 2500 include inner edges 2211 and 2513 which define suitably sized aligned cylindrical openings or apertures 2210 and 2510 for receiving a steel cylindrical locking pin 2114. The locking pin 2114 extends through aperture or opening 2211 in the first base 2200 and through aperture or opening 2515 in the second base 2500 and is secured in the bracket 2102 by a spring 2118 journaled about the locking pin 2114, a disc-shaped washer 2120 journaled about the locking pin 2114 below the spring 2118, and a stop 2124 extending transversely through a transverse hole 2123 in the locking pin 2114. The stop 2122 maintains or supports the washer 2120, and the spring 2118 is buttoned or bottomed against the washer 2120 to create the downward force on the locking pin 2114.

This embodiment of the lubricant free door lock 2100 of the present disclosure further includes: (a) a cylindrical replaceable locking pin wear protector 2300 securely insertable in and selectively removable from the first base 2200 to prevent the steel-on-steel contact between the locking pin 2114 and the inner edge of the first base 2200 which defines the aperture 2210 in the first base 2200; and (b) a cylindrical replaceable locking pin wear protector 2600 securely insertable in and selectively removable from the second base 2500 to prevent the steel-on-steel contact between the locking pin 2114 and the inner edge 2513 of the second base 2500 which defines the aperture 2510 in the second base 2500.

In this embodiment, the first or upper base 2200 has the same configuration as the first or upper base 1200, the first locking pin wear protector 2300 has the same configuration as the first locking pin wear protector 1300, the second or lower base 2500 has the same configuration as the second or lower base 1500, and the second locking pin wear protector 2600 has the same configuration as the second pin wear protector 1600. In this embodiment, the first or upper base 2200 is made from the same material as the first or upper base 1200, the first locking pin wear protector 2300 is made from the same material as the first locking pin wear protector 1300, the second or lower base 2500 is made from the same material as the second or lower base 1500, and the second locking pin wear protector 2600 is made from the same material as the second locking pin wear protector 1600. However, it should be appreciated that these components can be made in alternative configurations and can be made from alternative materials in accordance with the present disclosure. These locking pin wear protectors eliminate the need for a lubricant between the steel locking pin 2114 and the bases 2200 and 2500.

In this illustrated embodiment, the first or upper base 2200 is identical to the second or lower base 2500, and the locking pin wear protector 2300 is identical to the locking pin wear protector 2600. However, it should be appreciated that these components do not need to be identical in accordance with the present disclosure. It should also be appreciated that the bases 2200 and 2500 are secured or attached to the bracket 2100 in this illustrated embodiment such that they face each other, and that in alternative embodiments, the bases can be secured in other suitable manners such as facing away from each other, or both facing in one direction (such as an upward direction or a downward direction).

It should be appreciated that the locking pin receipt opening 2312 of the first locking pin wear protector 2300 has a smaller inner diameter than the locking pin receipt opening 2260 of the first base 2200. This configuration causes the locking pin 2114 to engage the inner edge or surface of the first locking pin wear protector 2300 instead of engaging the first base 2200. It should also thus be appreciated that the locking pin receipt opening 2612 of the second locking pin wear protector 2600 has a smaller inner diameter than the locking pin receipt opening 2560 of the second base 2500. This configuration causes the locking pin 2114 to engage the inner edge or surface of the first locking pin wear protector 2600 instead of engaging the second base 2500.

It should be appreciated that the other features, portions, parts and components of the above described embodiment of FIGS. 10 to 15 also apply to this embodiment.

Figure 19:
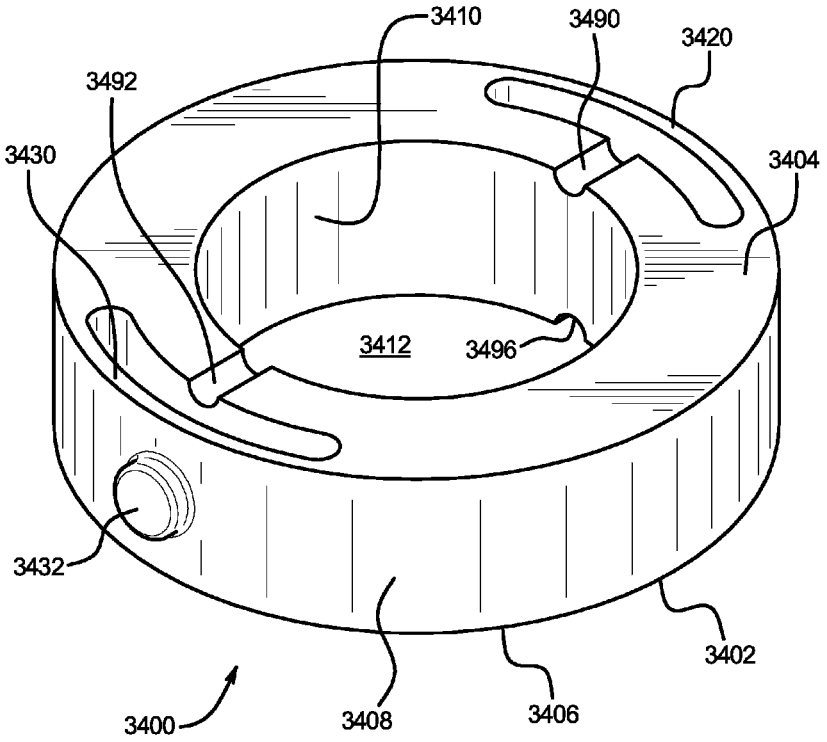
FIG. 19 is an enlarged perspective view of an alternative locking pin wear protector of the lubricant free door lock of the present disclosure.

Referring now to FIG. 19, an alternative embodiment of the locking pin wear protector of the lubricant free door lock of the present disclosure is generally illustrated and indicated by numeral 3400. This alternative pin wear protector 3400 includes a cylindrical body 3402 having a first surface 3404, a second surface 3406, a cylindrical outer side surface 3408, and a cylindrical inner edge or locking pin engagement shoulder 3410 which defines a locking pin receipt opening 3412. The inner edge or shoulder 3410 is configured to engage the locking pin (not shown in FIG. 19). The body 3402 defines or includes a first locking arm 3420 having a first outwardly or transversely extending base engagement pin (not shown), and a second locking arm 3430 having a second outwardly or transversely extending base engagement pin 3432. The locking arms 3420 and 3430 do not include free ends, but have both ends attached to the rest of the body 3402. In this embodiment, both locking arms are configured to bend or flex inwardly.

This locking pin wear protector 3400 is configured to be positioned in a base (such as any of the above described bases), and specifically in the locking pin wear protector receipt opening of a base such that: (1) the second surface 3408 engages or can engage the inner pin wear protector engagement shelf of the base; (2) the first base engagement pin extends into the first engagement pin receipt channel of the base; and (3) the second base engagement pin 3432 extends into the second engagement pin receipt channel in the base. This configuration securely (but removably) holds this locking pin wear protector 3400 in the base. An object can be inserted through the first channel in the base to dis-engage the first base engagement pin from the first engagement pin receipt channel, and thus enable the locking pin wear protector 3400 be removed from the base. This illustrated embodiment of the locking pin wear protector 3400 of the present disclosure further includes or defines aligned guides (such as grooves or water drains 3490, 3492, and 3496) which indicate to the installer the proper alignment of the engagement pins and thus the proper alignment of the locking pin wear protector 3400 in a base.

In various embodiments of the present disclosure, prior to installation, one or more components of the door lock of the present disclosure is primed and painted with a suitable rust preventing primer and paint.

It should be appreciated that the C-shaped bracket of the lubricant free door lock of the present disclosure can be formed in any suitable alternative manner or configuration.

It should be appreciated that the locking pin wear protectors can be securely or lockably attached to the bases in other suitable manners in accordance with alternative embodiments of the present disclosure.

It should be understood that modifications and variations may be effected without departing from the scope of the novel concepts of the present invention, and it should be understood that this application is to be limited only by the scope of the claims.

The invention is claimed as follows:

1. A railroad car door lock comprising:

a bracket having a side wall, a first end wall connected to and transversely extending from the side wall, and a second end wall connected to and transversely extending from the side wall, the second end wall being spaced-apart from the first end wall;

a locking pin;

a first base attached to the bracket such that the first base is not moveable with respect to the bracket, the first base including a first inner edge defining a first aperture;

a replaceable first locking pin wear protector securely attachable to and selectively removable from the first base, the replaceable first locking pin wear protector including a first locking pin engagement inner edge which defines a first locking pin receipt opening, the replaceable first locking pin wear protector configured to prevent contact between the locking pin and the first inner edge of the first base when the locking pin is received in the first aperture, the replaceable first locking pin wear protector including a first locking arm having a first transversely extending base engagement pin, the first locking arm configured to bend inwardly toward the first locking pin receipt opening of the replaceable first locking pin wear protector;

a second base attached to the bracket such that the second base is not moveable with respect to the bracket, the second base including a second inner edge defining a second aperture; and a replaceable second locking pin wear protector securely attachable to and selectively removable from the second base, the replaceable second locking pin wear protector including a second locking pin engagement inner edge which defines a second locking pin receipt opening, the replaceable second locking pin wear protector configured to prevent contact between the locking pin and the second inner edge of the second base when the locking pin is received in the second aperture.

2. The railroad car door lock of claim 1, wherein the replaceable first locking pin wear protector includes a second locking arm.

3. The railroad car door lock of claim 1, wherein the replaceable first locking pin wear protector includes a second locking arm having a second transversely extending base engagement pin.

4. The railroad car door lock of claim 3, wherein the second locking arm is configured to bend inwardly toward the first locking pin receipt opening of the replaceable first locking pin wear protector.

5. The railroad car door lock of claim 1, wherein the replaceable first locking pin wear protector includes a second locking arm having a second base engagement pin.

6. The railroad car door lock of claim 1, wherein the first base includes an inner locking pin wear protector engagement shelf and an inner locking pin wear protector engagement shoulder which define a locking pin wear protector receipt opening in which the replaceable first locking pin wear protector is received.

7. The railroad car door lock of claim 1, wherein the first base defines a first transversely extending engagement pin receipt channel.

8. The railroad car door lock of claim 7, wherein the first base defines a second transversely extending engagement pin receipt channel.

9. The railroad car door lock of claim 1, wherein the first base is attached to a top surface of the first end wall, and the second base is attached to a bottom surface of the second end wall, wherein the replaceable first locking pin wear protector prevents contact between the locking pin and an inner edge of the first end wall that defines a first aperture, and the replaceable second locking pin wear protector prevents contact between the locking pin and an inner edge of the second end wall that defines the second aperture when the locking pin is received in the first aperture of the first base and the second aperture of the second base, and when the locking pin is received in the first aperture defined by the first end wall and the second aperture defined by the second end wall.

10. The railroad car door lock of claim 9, wherein the locking pin receipt opening of the replaceable first locking pin wear protector has a smaller diameter than a diameter of the first aperture of the first base, and the diameter of the first aperture of the first base is smaller than a diameter of the first aperture of the first end wall.

11. The railroad car door lock of claim 10, wherein to replace the replaceable first locking pin wear protector, the replaceable first locking pin wear protector is removable from the first base and movable through the first aperture in the first end wall.

12. The railroad car door lock of claim 9, wherein the bracket is steel, the first base is steel, and the first base is welded to the top surface of the first end wall.

13. The railroad car door lock of claim 12, wherein the second base is steel, and the second base is welded to the bottom surface of the second end wall.

14. The railroad car door lock of claim 1, wherein the first base is attached to the first end wall and the second end wall, and the second base is attached to the first end wall and the second end wall.

15. The railroad car door lock of claim 14, wherein the locking pin receipt opening of the replaceable first locking pin wear protector has a smaller diameter than the first aperture of the first base.

16. The railroad car door lock of claim 1, wherein the replaceable first and second locking pin wear protectors are each made from a dry self-lubricating material having non-hygroscopic characteristics, a low coefficient of friction, a high compressive strength, and a high resistance to wear.

17. The railroad car door lock of claim 1, wherein the replaceable first and second locking pin wear protectors are each made from a polymer.

18. The railroad car door lock of claim 1, wherein the replaceable first and second locking pin wear protectors are each made from a urethane.

19. A railroad car door lock comprising:

a bracket having a side wall, a first end wall connected to and transversely extending from the side wall, and a second end wall connected to and transversely extending from the side wall, the second end wall being spaced-apart from the first end wall;

a locking pin;

a first base attached to the bracket, the first base including a first inner edge defining a first aperture, and an inner locking pin wear protector engagement shelf and an inner locking pin wear protector engagement shoulder which define a first locking pin wear protector receipt opening, the first base defining a first transversely extending engagement pin receipt channel and a second transversely extending engagement pin receipt channel;

a replaceable first locking pin wear protector securely attachable to and selectively removable from the first locking pin wear protector receipt opening of the first base, the replaceable first locking pin wear protector including a first inwardly bendable locking arm having a first transversely extending base engagement pin and a second inwardly bendable locking arm having a second transversely extending base engagement pin, the replaceable first locking pin wear protector including a first locking pin engagement inner edge which defines a first locking pin receipt opening, the replaceable first locking pin wear protector configured to prevent contact between the locking pin and the first inner edge of the first base when the locking pin is received in the first aperture;

a second base attached to the bracket, the second base including a second inner edge defining a second aperture, and a second inner locking pin wear protector engagement shelf and a second inner locking pin wear protector engagement shoulder which define a second locking pin wear protector receipt opening, the second base defining a third transversely extending engagement pin receipt channel and a fourth transversely extending engagement pin receipt channel; and a replaceable second locking pin wear protector securely attachable to and selectively removable from the second locking pin wear protector receipt opening of the second base, the replaceable second locking pin wear protector including a third inwardly bendable locking arm having a third transversely extending base engagement pin and a fourth inwardly bendable locking arm having a fourth transversely extending base engagement pin, the replaceable second locking pin wear protector including a second locking pin engagement inner edge which defines a second locking pin receipt opening, the replaceable second locking pin wear protector configured to prevent contact between the locking pin and the second inner edge of the second base when the locking pin is received in the second aperture.

20. The railroad car door lock of claim 19, wherein the first base is attached to a top surface of the first end wall, and the second base is attached to a bottom surface of the second end wall.

21. The railroad car door lock of claim 20, wherein the locking pin receipt opening of the first locking pin wear protector has a smaller diameter than a diameter of the first aperture of the first base, and the diameter of the first aperture of the first base is smaller diameter than a diameter of a first aperture defined by an inner edge of the first end wall.

22. The railroad car door lock of claim 21, wherein to replace the first locking pin wear protector, the first locking pin wear protector is removable from the first base and movable through the first aperture in the first end wall.

23. The railroad car door lock of claim 22, wherein to replace the second locking pin wear protector, the second locking pin wear protector is removable from the second base and movable through a second aperture in the second end wall.

24. The railroad car door lock of claim 19, wherein the first base is attached to the first end wall and the second end wall, and the second base is attached to the first end wall and the second end wall.

25. The railroad car door lock of claim 19, wherein the replaceable first and second locking pin wear protectors are each made from a dry self-lubricating material having non-hygroscopic characteristics, a low coefficient of friction, a high compressive strength, and a high resistance to wear.

26. The railroad car door lock of claim 19, wherein the replaceable first and second locking pin wear protectors are each made from a polymer.

27. The railroad car door lock of claim 19, wherein the replaceable first and second locking pin wear protectors are each made from a urethane.

28. A railroad car door lock comprising:

a bracket having a side wall, a first end wall connected to and transversely extending from the side wall, and a second end wall connected to and transversely extending from the side wall, the second end wall being spaced-apart from the first end wall;

a locking pin;

a first base attached to the bracket, the first base including a first inner edge defining a first aperture, the first base including an inner locking pin wear protector engagement shelf and an inner locking pin wear protector engagement shoulder which define a first locking pin wear protector receipt opening;

a replaceable first locking pin wear protector receivable in the locking pin wear protector receipt opening and securely attachable to and selectively removable from the first base, the replaceable first locking pin wear protector including a first locking pin engagement inner edge which defines a first locking pin receipt opening, the replaceable first locking pin wear protector configured to prevent contact between the locking pin and the first inner edge of the first base when the locking pin is received in the first aperture;

a second base attached to the bracket, the second base including a second inner edge defining a second aperture; and a replaceable second locking pin wear protector securely attachable to and selectively removable from the second base, the replaceable second locking pin wear protector including a second locking pin engagement inner edge which defines a second locking pin receipt opening, the replaceable second locking pin wear protector configured to prevent contact between the locking pin and the second inner edge of the second base when the locking pin is received in the second aperture.

29. The railroad car door lock of claim 28, wherein the replaceable first locking pin wear protector includes a first locking arm.

30. The railroad car door lock of claim 29, wherein the replaceable first locking pin wear protector includes a second locking arm.

31. The railroad car door lock of claim 28, wherein the replaceable first locking pin wear protector includes a first locking arm having a first transversely extending base engagement pin.

32. The railroad car door lock of claim 31, wherein the first locking arm is configured to bend inwardly toward the first locking pin receipt opening of the replaceable first locking pin wear protector.

33. The railroad car door lock of claim 32, wherein the replaceable first locking pin wear protector includes a second locking arm having a second transversely extending base engagement pin.

34. The railroad car door lock of claim 33, wherein the second locking arm is configured to bend inwardly toward the first locking pin receipt opening of the replaceable first locking pin wear protector.

35. The railroad car door lock of claim 31, wherein the replaceable first locking pin wear protector includes a second locking arm having a second base engagement pin.

36. The railroad car door lock of claim 28, wherein the first base defines a first transversely extending engagement pin receipt channel.

37. The railroad car door lock of claim 36, wherein the first base defines a second transversely extending engagement pin receipt channel.

38. The railroad car door lock of claim 28, wherein the replaceable first and second locking pin wear protectors are each made from a dry self-lubricating material having non-hygroscopic characteristics, a low coefficient of friction, a high compressive strength, and a high resistance to wear.

39. The railroad car door lock of claim 28, wherein the replaceable first and second locking pin wear protectors are each made from a polymer.

40. The railroad car door lock of claim 28, wherein the replaceable first and second locking pin wear protectors are each made from a urethane.

41. A railroad car door lock comprising:

a steel bracket having a side wall, a first end wall connected to and transversely extending from the side wall, and a second end wall connected to and transversely extending from the side wall, the second end wall being spaced-apart from the first end wall;

a locking pin;

a steel first base welded to a top surface of the first end wall of the bracket, the first base including a first inner edge defining a first aperture;

a replaceable first locking pin wear protector securely attachable to and selectively removable from the first base, the replaceable first locking pin wear protector including a first locking pin engagement inner edge which defines a first locking pin receipt opening, the replaceable first locking pin wear protector configured to prevent contact between the locking pin and the first inner edge of the first base when the locking pin is received in the first aperture;

a steel second base welded to a bottom surface of the second end wall of the bracket, the second base including a second inner edge defining a second aperture; and a replaceable second locking pin wear protector securely attachable to and selectively removable from the second base, the replaceable second locking pin wear protector including a second locking pin engagement inner edge which defines a second locking pin receipt opening, the replaceable second locking pin wear protector configured to prevent contact between the locking pin and the second inner edge of the second base when the locking pin is received in the second aperture, wherein the replaceable first locking pin wear protector prevents contact between the locking pin and an inner edge of the first end wall that defines a first aperture, and the replaceable second locking pin wear protector prevents contact between the locking pin and an inner edge of the second end wall that defines the second aperture when the locking pin is received in the first and second apertures of the first and second bases, respectively, and is received in the first and second apertures defined by the first and second end walls, respectively.

42. The railroad car door lock of claim 41, wherein the locking pin receipt opening of the replaceable first locking pin wear protector has a smaller diameter than a diameter of the first aperture of the first base, and the diameter of the first aperture of the first base is smaller than a diameter of the first aperture of the first end wall.

43. The railroad car door lock of claim 42, wherein to replace the replaceable first locking pin wear protector, the replaceable first locking pin wear protector is removable from the first base and movable through the first aperture in the first end wall.

44. The railroad car door lock of claim 41, wherein the replaceable first and second locking pin wear protectors are each made from a dry self-lubricating material having non-hygroscopic characteristics, a low coefficient of friction, a high compressive strength, and a high resistance to wear.

45. The railroad car door lock of claim 41, wherein the replaceable first and second locking pin wear protectors are each made from a polymer.

46. The railroad car door lock of claim 41, wherein the replaceable first and second locking pin wear protectors are each made from a urethane.

47. A railroad car door lock comprising:

a bracket having a side wall, a first end wall connected to and transversely extending from the side wall, and a second end wall connected to and transversely extending from the side wall, the second end wall being spaced-apart from the first end wall;

a locking pin;

a first base attached to the bracket such that the first base is not moveable with respect to the bracket, the first base including a first inner edge defining a first aperture, the first base including an inner locking pin wear protector engagement shelf and an inner locking pin wear protector engagement shoulder which define a locking pin wear protector receipt opening in which the replaceable first locking pin wear protector is received;

a replaceable first locking pin wear protector securely attachable to and selectively removable from the first base, the replaceable first locking pin wear protector including a first locking pin engagement inner edge which defines a first locking pin receipt opening, the replaceable first locking pin wear protector configured to prevent contact between the locking pin and the first inner edge of the first base when the locking pin is received in the first aperture;

a second base attached to the bracket such that the second base is not moveable with respect to the bracket, the second base including a second inner edge defining a second aperture; and a replaceable second locking pin wear protector securely attachable to and selectively removable from the second base, the replaceable second locking pin wear protector including a second locking pin engagement inner edge which defines a second locking pin receipt opening, the replaceable second locking pin wear protector configured to prevent contact between the locking pin and the second inner edge of the second base when the locking pin is received in the second aperture.

48. A railroad car door lock comprising:

a bracket having a side wall, a first end wall connected to and transversely extending from the side wall, and a second end wall connected to and transversely extending from the side wall, the second end wall being spaced-apart from the first end wall;

a locking pin;

a first base attached to the bracket such that the first base is not moveable with respect to the bracket, the first base including a first inner edge defining a first aperture, the first base attached to a top surface of the first end wall;

a replaceable first locking pin wear protector securely attachable to and selectively removable from the first base, the replaceable first locking pin wear protector including a first locking pin engagement inner edge which defines a first locking pin receipt opening, the replaceable first locking pin wear protector configured to prevent contact between the locking pin and the first inner edge of the first base when the locking pin is received in the first aperture;

a second base attached to the bracket such that the second base is not moveable with respect to the bracket, the second base including a second inner edge defining a second aperture, the second base is attached to a bottom surface of the second end wall;

a replaceable second locking pin wear protector securely attachable to and selectively removable from the second base, the replaceable second locking pin wear protector including a second locking pin engagement inner edge which defines a second locking pin receipt opening, the replaceable second locking pin wear protector configured to prevent contact between the locking pin and the second inner edge of the second base when the locking pin is received in the second aperture;

wherein when the locking pin is received in the first aperture of the first base and the second aperture of the second base, and when the locking pin is received in a first aperture defined by the first end wall and a second aperture defined by the second end wall, the replaceable first locking pin wear protector prevents contact between the locking pin and an inner edge of the first end wall that defines the first aperture, and the replaceable second locking pin wear protector prevents contact between the locking pin and an inner edge of the second end wall that defines the second aperture; and wherein the bracket is steel, the first base is steel, and the first base is welded to the top surface of the first end wall.

49. The railroad car door lock of claim 48, wherein the second base is steel, and the second base is welded to the bottom surface of the second end wall.

* * * * *